US008118586B2

(12) United States Patent
Trebilcock et al.

(10) Patent No.: US 8,118,586 B2
(45) Date of Patent: Feb. 21, 2012

(54) PORTABLE CONDUIT BENDING FRAME ASSEMBLY AND METHOD OF USE THEREOF

(76) Inventors: Herbert A. Trebilcock, Kentwood, MI (US); Salvatore Anastasi, Media, PA (US)

( * ) Notice: Subject to any disclaimer, the term of this patent is extended or adjusted under 35 U.S.C. 154(b) by 57 days.

(21) Appl. No.: 12/820,708

(22) Filed: Jun. 22, 2010

(65) Prior Publication Data

US 2010/0257908 A1 Oct. 14, 2010

Related U.S. Application Data

(63) Continuation-in-part of application No. 11/559,327, filed on Nov. 13, 2006, now Pat. No. 7,766,642.

(51) Int. Cl.
*B28B 21/98* (2006.01)
*B28B 21/92* (2006.01)

(52) U.S. Cl. ..... 425/403; 425/392; 425/393

(58) Field of Classification Search ..... 425/393, 425/403

See application file for complete search history.

(56) References Cited

U.S. PATENT DOCUMENTS

| | | | |
|---|---|---|---|
| 1,610,196 | A | 12/1926 | Blaisdell |
| 2,349,525 | A | 5/1944 | Clair |
| 3,184,796 | A | 5/1965 | Southcott et al. |
| 3,546,917 | A | 12/1970 | Gardner et al. |
| 3,753,635 | A | 8/1973 | Barnett |
| 3,776,539 | A | 12/1973 | Curtis et al. |
| 3,939,764 | A | 2/1976 | McCormack |
| 4,255,378 | A | 3/1981 | Miller et al. |
| 5,125,825 | A | 6/1992 | Janosco |
| 5,200,124 | A | 4/1993 | Bowkett |
| D416,566 | S | 11/1999 | Perez |
| 6,257,880 | B1 | 7/2001 | Hirayama |
| 6,561,797 | B1 | 5/2003 | Johnson |
| 7,766,642 | B2 | 8/2010 | Trebilcock |

*Primary Examiner* — Yogendra Gupta
*Assistant Examiner* — Alison Hindenlang
(74) *Attorney, Agent, or Firm* — Barley Snyder

(57) ABSTRACT

A portable conduit bending frame assembly has a support member, a shoe and a heating device. The support member has a first alignment end, a second alignment end, and a first conduit measuring device that extends an approximate width of the support member. The support member also has a flat conduit support surface fixed thereto, and extending substantially perpendicular to a top surface of the support member. The top surface has at least a portion of a first attachment strip located thereon. The shoe has a first alignment surface extending substantially perpendicular to a second alignment surface, an arcuate conduit bending surface extending between the first and second alignment surfaces, and a complementary attachment strip extending at least partially on a major surface of the shoe. The conduit bending surface faces the conduit support surface and the shoe is removably attachable to the top surface such that either of its alignment surfaces can be aligned parallel with either alignment end of the support member. The heating device is arranged proximate the conduit support surface for heating a conduit prior to bending the conduit at least partially about the conduit bending surface.

18 Claims, 15 Drawing Sheets

FIG. 4
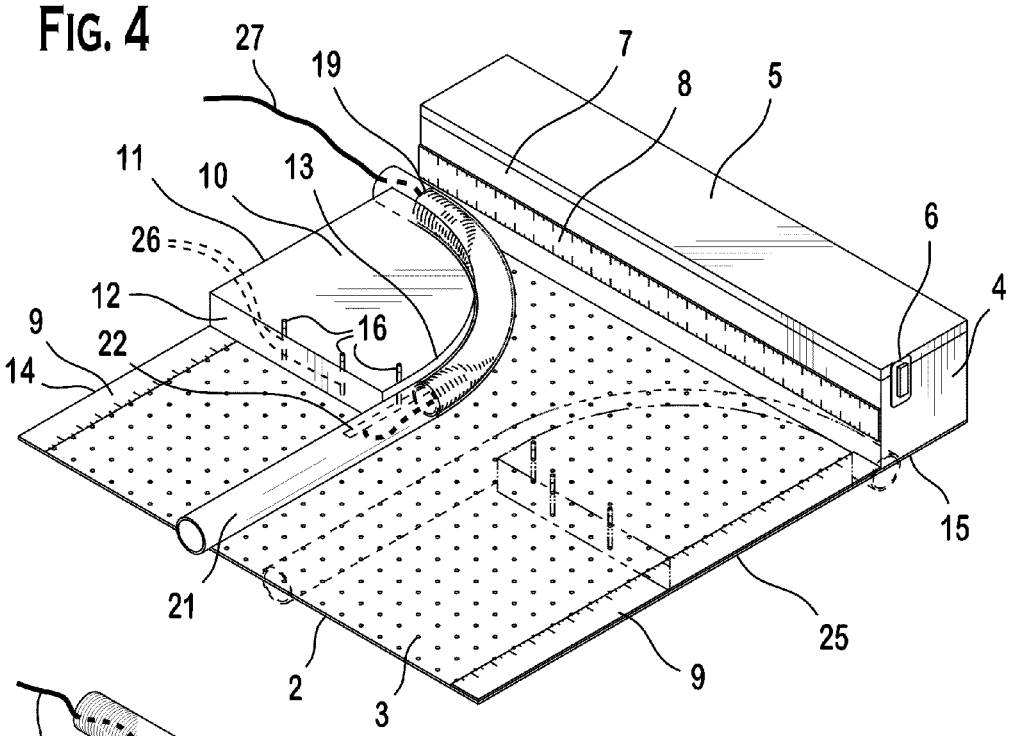
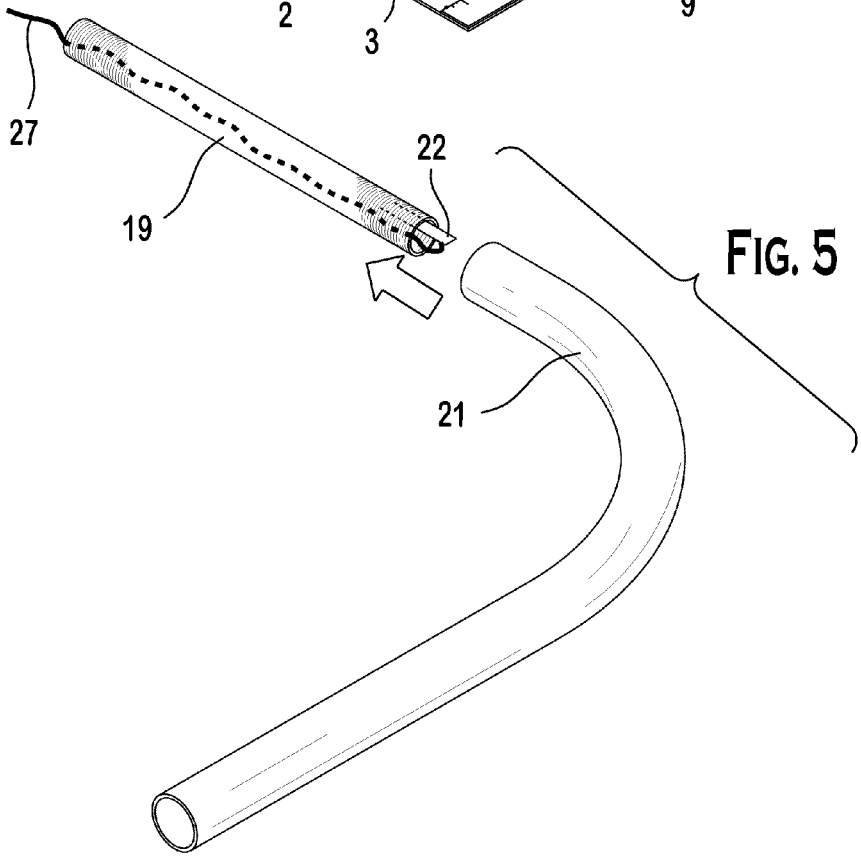
FIG. 5

PORTABLE CONDUIT BENDING FRAME ASSEMBLY AND METHOD OF USE THEREOF

RELATED APPLICATION DATA

This application is a continuation in part application of application Ser. No. 11/559,327 filed Nov. 13, 2006, now U.S. Pat. No. 7,766,642.

FIELD OF THE INVENTION

The invention relates to a portable conduit bending frame assembly and method of bending a conduit utilizing the same.

BACKGROUND

Conduits requiring a plurality of bends or offsets are preferably fabricated, formed, or bent to a desired configuration at the site where the conduits are to be installed. In order to fabricate the conduit on site, several pre-formed or pre-bent conduit components are fixed together with couplings to form a desired configuration. Because several conduit components having different bends or offsets must be brought to the site in order to fabricate the conduit, this type of fabrication requires transporting a large amount of conduit components to every site. Additionally, the couplings add to the final cost of the conduit. Alternatively, to form or bend the conduit on site, the conduit must be heated to a temperature where the conduit is capable of being formed or bent to a desired configuration. Conventional methods for heating the conduit, however, are bulky and inefficient. It is therefore desirable to provide a portable conduit bending frame assembly that is easy to transport and operate that can economically heat and form or bend a conduit to a desired configuration.

SUMMARY

The invention provides a portable conduit bending frame assembly has a support member, a shoe and a heating device. The support member has a first alignment end, a second alignment end, and a first conduit measuring device that extends an approximate width of the support member. The support member also has a flat conduit support surface fixed thereto, and extending substantially perpendicular to a top surface of the support member. The top surface has at least a portion of a first attachment strip located thereon. The shoe has a first alignment surface extending substantially perpendicular to a second alignment surface, an arcuate conduit bending surface extending between the first and second alignment surfaces, and a complementary attachment strip extending at least partially on a major surface of the shoe. The conduit bending surface faces the conduit support surface and the shoe is removably attachable to the top surface such that either of its alignment surfaces can be aligned parallel with either alignment end of the support member. The heating device is arranged proximate the conduit support surface for heating a conduit prior to bending the conduit at least partially about the conduit bending surface.

BRIEF DESCRIPTION OF THE DRAWINGS

FIG. 4 is a perspective view of a third step in the method of bending the conduit using the portable conduit bending frame assembly of FIG. 1.

FIG. 5 is a perspective view of a fourth step in the method of bending the conduit using the portable conduit bending frame assembly of FIG. 1.

DETAILED DESCRIPTION OF THE EMBODIMENTS

Figure 1:
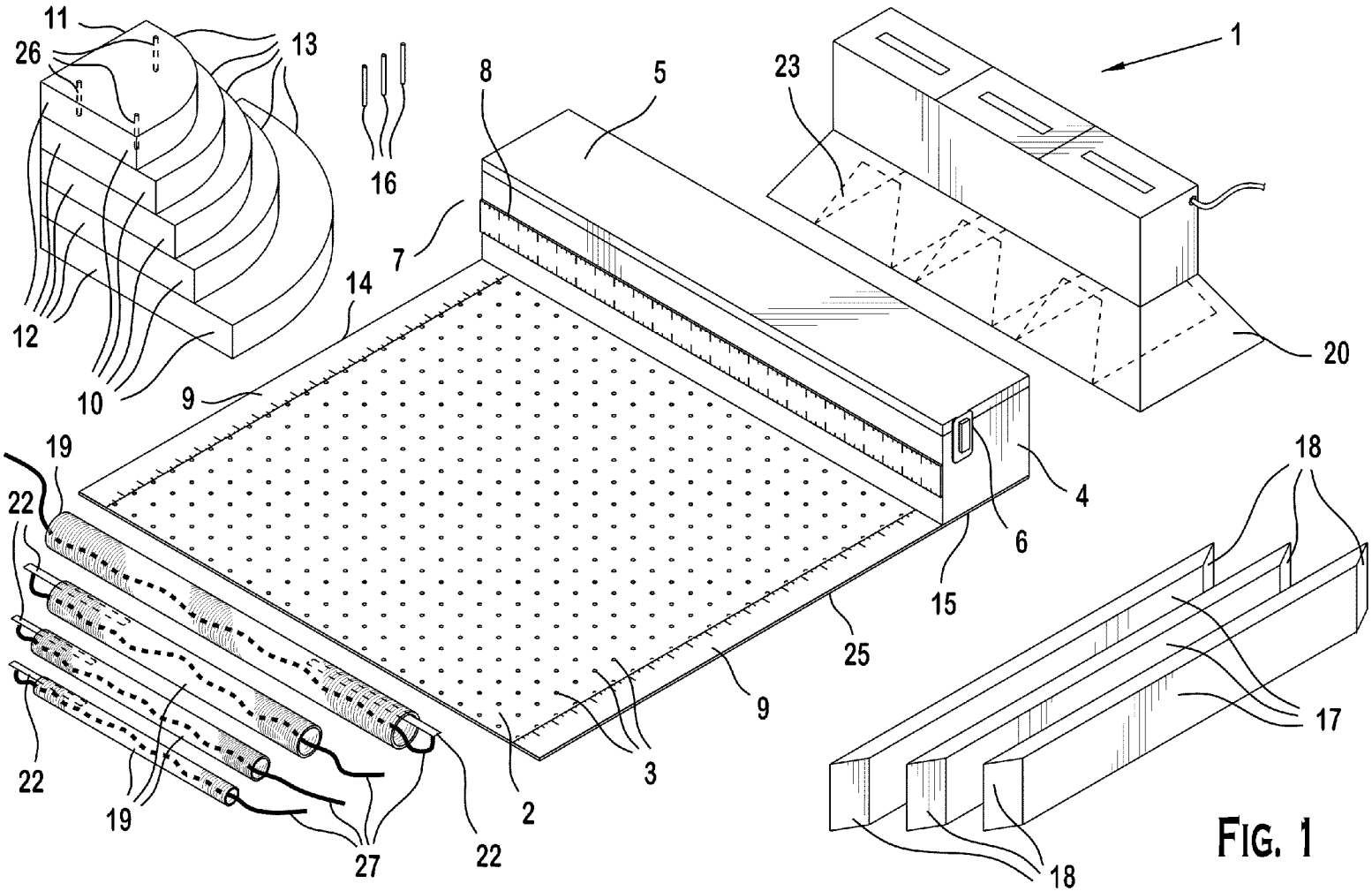
FIG. 1 is a top perspective view of a portable conduit bending frame assembly according to a first embodiment of the invention.

FIGS. 1-6 show a portable conduit bending frame assembly 1 according to a first embodiment of the invention. As shown in FIG. 1, the portable conduit bending frame assembly 1 includes a support member 2, a storage container 4, a plurality of shoes 10, a plurality of shoe attachment members 16, a plurality of shims 17, a plurality of springs 19, and a heating device 20. Each of the individual elements of the bending frame assembly 1 will now be described in greater detail.

As shown in FIG. 1, the support member 2 is substantially rectangular and is provided with a plurality of apertures 3. The support member 2 may be formed, for example, from a non-conductive material, such as a mineral wool peg board, or a heat tolerant material, such as aluminum. The support member 2 includes first and second alignment ends 14, 25, respectively, and a conduit receiving end 15. The first and second alignment ends 14, 25 extend substantially perpendicular to the conduit receiving end 15. The first and second alignment ends 14, 25 extend in a direction of length of the support member 2, and the conduit receiving end 15 extends in a direction of width of the support member 2. The length of the support member 2 may be, for example, about 21 inches and the width of the support member 2 may be, for example, about 24 inches.

As shown in FIG. 1, the storage container 4 is mounted to the conduit receiving end 15 of the support member 2. The storage container 4 is substantially rectangular in shape and includes a cover 5 rotatably mounted thereto. The storage container 4 may, for example, have a width of about 5.5 inches and a length substantially similar to the width of the support member 2. A locking mechanism 6 secures the cover 5 to the storage container 4 in a closed position. One side of the storage container 4 is formed as a conduit support surface 7. The conduit support surface 7 extends the approximate length of the support member 2 and is positioned substantially parallel thereto. The storage container 4 is provided with a handle (not shown) that facilitates carrying the support member 2.

As shown in FIG. 1, a first conduit measuring device 8 is provided on the conduit support surface 7. The first conduit measuring device 8 extends the approximate width of the support member 2. The first conduit measuring device 8 may have, for example, units of measurement that measure from the first alignment end 14 to the second alignment end 25 and/or from the second alignment end 25 to the first alignment end 14. Second conduit measuring devices 9 extend substantially perpendicular to the first conduit measuring device 8 along the first and second alignment ends 14, 25. The second conduit measuring devices 9 extend the approximate length of the support member 2. The first and second conduit measuring devices 8, 9 may be, for example, provided with units of measurement, such as notches, metric units, English units, etc.

As shown in FIG. 1, each of the shoes 10 has first and second alignment surface 11, 12, respectively. The first alignment surface 11 extends substantially perpendicular to the second alignment surface 12. A conduit bending surface 13 extends between the first surface 11 and the second surface 13. The conduit bending surface 13 has a substantially arcuate configuration. The first and second alignment surfaces 11, 12 and the conduit bending surface 13 are formed to have a desired dimension. The substantially arcuate configuration of the conduit bending surface 13 may be, for example, the minimum arcuate configuration specified by the national electric code. For example, the shoes 10 may have a radius of between about 5 inches and 17 inches, however, other dimensions are possible. In the illustrated embodiment, a plurality of the shoes 10 are provided, which each have a different dimension.

Shoe attachment member receiving openings 26 are formed in the shoes 10 and extend from a bottom surface to a top surface thereof. The shoe attachment member receiving openings 26 are arranged a distance from the first and second alignment surfaces 11, 12 and the conduit bending surface 13 of the shoe 10. The shoe attachment member receiving openings 26 correspond to the apertures 3 of the support member 2. Each of the shoes 10 may be formed with a plurality of weight reducing openings (not shown) that extend between the top surface and the bottom surface of the shoes 10. The weight reducing openings (not shown) provide for easier handling when positioning and removing the shoes 10. The shoes 10 may be formed, for example, from wood, aluminum, fiberglass, etc.

As shown in FIG. 1, the shoe attachment members 16 are substantially cylindrical and correspond to the shoe attachment member receiving openings 26 of the shoes 10 and the apertures 3 of the support member 2. The shoe attachment members 16 have a length such that a portion of the shoe attachment members 16 extends from the top and bottom surface of the shoes 10. It will be appreciated by those skilled in the art that the shoe attachment members 16 may alternatively be formed integrally with the shoes 10 or the support member 2. The shoe attachment members 16 may be formed, for example, from wood, aluminum, fiberglass, or a heat tolerant material.

As shown in FIG. 1, the shims 17 are substantially rectangular in shape and have at least one beveled end 18. The beveled ends 18 are formed to have a desired dimension. In the illustrated embodiment, a plurality of the shims 17 are provided, which each have a different thickness and beveled ends of different angular dimensions. The shims 17 may, for example, have a thickness of between about ⅛ inch and ¾ inch, however other dimensions are possible. The shims 17 may be formed, for example, from wood, aluminum, fiberglass, sheet felt, etc.

As shown in FIG. 1, the springs 19 are substantially elongated in shape and are formed to have an external dimension and length. In the illustrated embodiment, a plurality of the springs 19 are provided, which each have a different external dimension and length. A tape 22 may be woven through a first end of the spring 19. A pulling member 27, such as steel fish tape, may be attached to the tape 22. In the illustrated embodiment, the pulling member 27 is fed through the spring 19 such that the pulling member 27 extends from the second end of the spring 19. Alternatively, the pulling member 27 may be directly attached to the first end of the spring 19. It will be appreciated by those skilled in the art that structures other than springs 19 may also be provided.

As shown in FIG. 1, the heating device 20 is substantially rectangular in shape and has a length substantially corresponding to the length of the support member 2. The heating device 20 is provided with a plurality of radiation elements 23 that radiate heat toward a heat emitting surface of the heating device 20. The radiation elements 23 may be, for example, a plurality of 500 Watt halogen heat strip bulbs. It will be appreciated by those skilled in the art, however, that the wattage of the halogen heat strip bulbs may vary depending of the desired speed of heating. The radiation elements 23 may also be individually controlled. A metal guard (not shown) may be provided between the radiation elements 23 and the heat emitting surface of the heating device 20. The heating device 20 may be any of a variety of conventional heating devices that is portable and is capable of radiating heat.

A method of bending a conduit 21 using the portable conduit bending frame assembly 1 according to the first embodiment of the invention will now be described with reference to FIGS. 2-6. It will be appreciated by those skilled in the art that the conduit 21 may include a pipe or other tubular member formed, for example, from a non-metallic material, such as a schedule 40 pipe, water conduit, elect conduit, etc.

Figure 2:
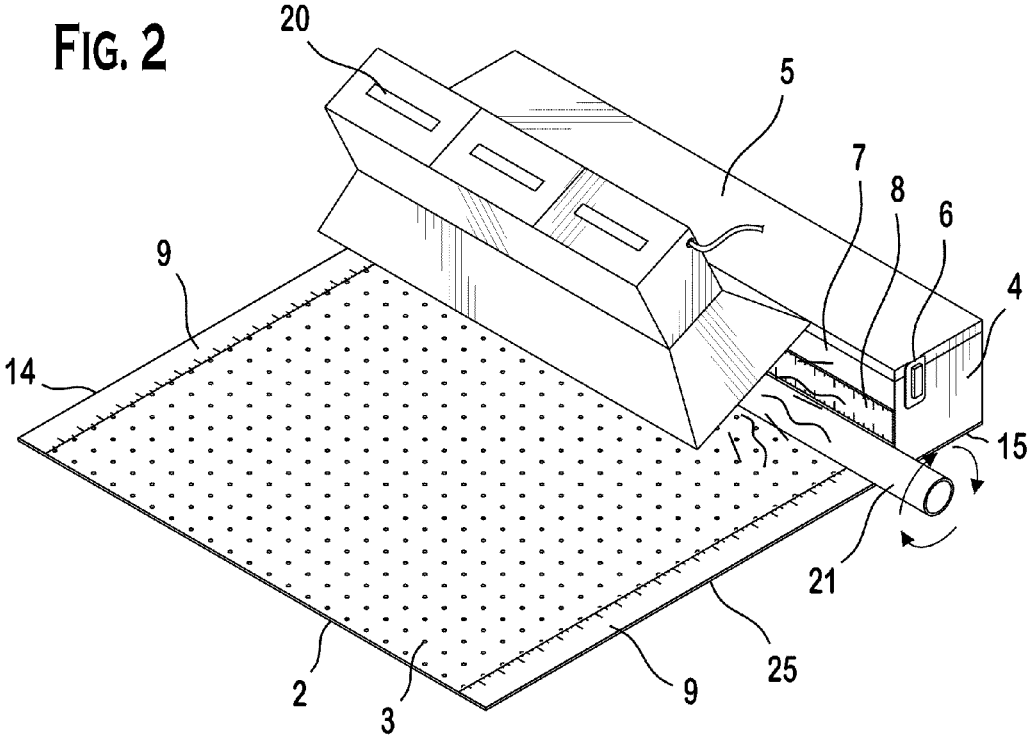
FIG. 2 is a perspective view of a first step in a method of bending a conduit using the portable conduit bending frame assembly of FIG. 1.

As shown in FIG. 2, one of the springs 19 is inserted into the conduit 21 such that the pulling member 27 protrudes from an end of the conduit 21 opposite from the tape 22. A lubricant (not shown), such as liquid soap or a non-stick spray, may be applied to the spring 19 and/or the conduit 21 before insertion of the spring 19 into the conduit 21. The external dimension of the spring 19 substantially corresponds to an internal dimension of the conduit 21. The conduit 21 is positioned on the conduit receiving end 15 of the support member 2 against the support surface 7 of the storage container 4 such that the conduit 21 extends in the direction of length of the support member 2. The heat emitting surface of the heating device 20 is positioned proximate the conduit 21 such that the radiation elements 23 radiate heat toward the conduit 21. The metal guard (not shown) of the heating device 20 may optionally be positioned such that the metal guard (not shown) is in contact with the conduit 21. As the conduit 21 is heated, the conduit 21 is periodically rotated in a direction of the arrows shown in FIG. 2 until the conduit 21 is heated to a temperature where it is substantially rubbery and/or capable of being bent with no or minimal resistance. Because the spring 19 is provided inside the conduit 21, the spring 19, which conducts heat, contributes to heating the conduit 21. Once the conduit 21 has been heated, the heating device 20 is removed from the support member 2.

Figure 3:
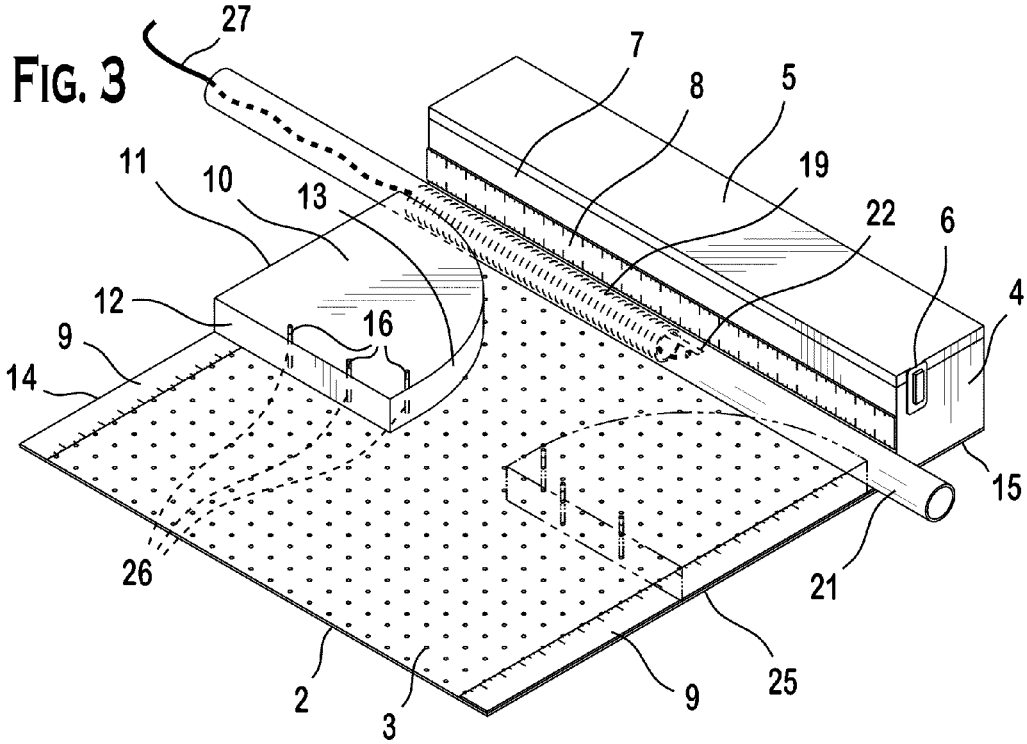
FIG. 3 is a perspective view of a second step in the method of bending the conduit using the portable conduit bending frame assembly of FIG. 1.

As shown in FIG. 3, at least one of the shoes 10 is attached to the support member 2. The shoe attachment members 16 are inserted into a plurality of the apertures 3 of the support member 2. The shoe 10 is attached to the support member 2 by aligning the first alignment surface 11 of the shoe 10 substantially parallel to the first alignment end 14 of the support member 2 such that the conduit 21 is sandwiched between the conduit bending surface 13 of the shoe 10 and the support surface 7 of the storage container 4. Alternatively, the shoe 10 may be attached to the support member 2 by aligning the first alignment surface 11 of the shoe 10 substantially parallel to the second alignment end 25 of the support member 2 such that the conduit 21 is sandwiched between the conduit bending surface 13 of the shoe 10 and the support surface 7 of the storage container 4, as shown in phantom in FIG. 3. The shoe attachment members 16 are received in the shoe attachment member receiving openings 26 of the shoe 10 to fix the shoe 10 relative to the support member 2.

As shown in FIG. 4, an end of the conduit 21 positioned farthest from the shoe 10 is pulled away from the support surface 7 such that the conduit 21 is bent about the conduit bending surface 13 with no or minimal resistance. The conduit 21 is bent until the conduit 21 concentrically embraces the substantially arcuate configuration of the conduit bending surface 13 of the shoe 10. Because the spring 19 is provided inside the conduit 21, the spring 19 prevents the internal dimension of the conduit 21 from constricting or deforming when the conduit 21 is bent about the conduit bending surface 13 of the shoe 10. Once the conduit 21 is bent to the desired configuration, the conduit 21 is allowed to cool and is then removed from the support member 2.

The spring 19 is removed from the conduit 21 by pulling on the pulling member 27 protruding from the end of the conduit 21, as shown in FIG. 5. Because the tape 22 is attached to the first end of the spring 19 and the pulling member 27, which is attached to the tape 22, extends from the second end of the spring 19, the spring 19 is prevented from stretching when the spring 19 is pulled from the conduit 21.

Figure 6:
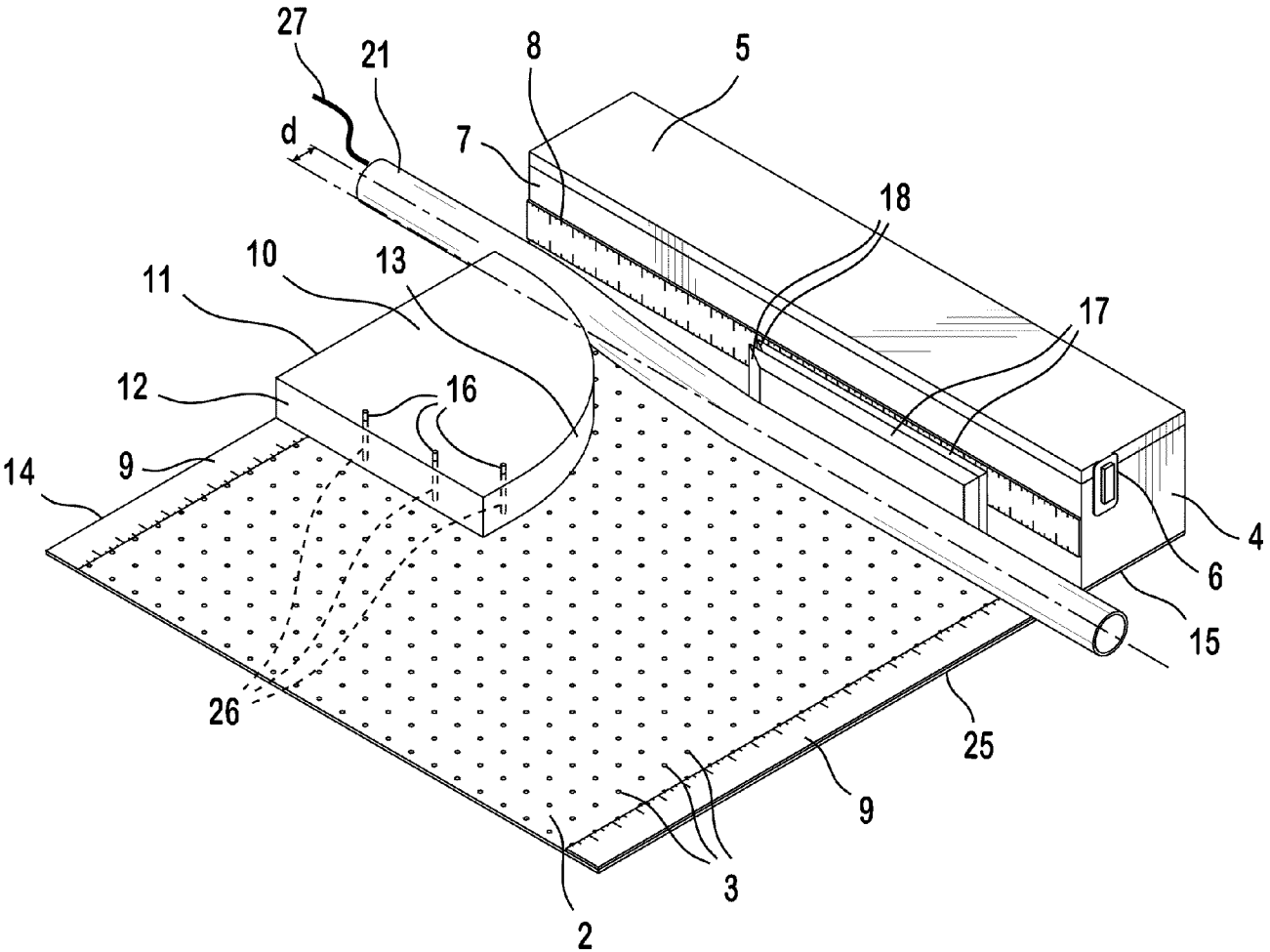
FIG. 6 is a perspective view of a second method of bending the conduit using the portable conduit bending frame assembly of FIG. 1.

FIG. 6 shows a second method of bending the conduit 21. As shown in FIG. 6, after the conduit 21 is heated to a temperature where it is substantially rubbery and/or capable of being bent with no or minimal resistance, at least one of the shims 17 may be positioned substantially parallel to and against the support surface 7 of the storage container 4 such that the beveled edges 18 extend in a direction of a desired offset d in the conduit 21. In the illustrated embodiment two of the shims 17 are positioned substantially parallel to and against the support surface 7 of the storage container 4. The conduit 21 is re-positioned against the support surface 7 such that the conduit 21 extends in the direction of width of the support member 2 and is positioned against the shims 17.

The shoe 10 is attached to the support member 2 by aligning the first alignment surface 11 of the shoe 10 substantially parallel to the first alignment end 14 of the support member 2 such that the conduit 21 is sandwiched between the conduit bending surface 13 of the shoe 10 and the support surface 7. The shoe attachment members 16 are received in the shoe attachment member receiving openings 26 of the shoe 10 to fix the shoe 10 relative to the support member 2. As a result of the conduit 21 being partially bent about the conduit bending surface 13 and engaging with the beveled edges 18 of the shims 17, the offset d is formed in the conduit 21.

Alternatively, at least one of the shims 17 may be positioned against the support surface 7 and substantially above the shoe 10. The conduit 21 is positioned between the conduit bending surface 13 of the shoe 10 and the shim 17. The conduit 21 is then bent about the bending surface 13 to form a bend in the conduit 21 when the shoe 10 provided to bend the conduit 21 is configured for a conduit having a larger diameter than the diameter of the conduit 21 desired to be bent. As a result, each of the shoes 10 can be used to bend the conduits 21 regardless of their diameters.

Although the conduit 21 is only illustrated as being formed with a single bend or offset d, it will be appreciated by those skilled in the art that the conduit 21 may be formed to have a plurality of bends and/or offsets d. Additionally, because the first conduit measuring device 8 may have, for example, units of measurement that measure from the first alignment end 14 to the second alignment end 25 and from the second alignment end 25 to the first alignment end 14, the conduit 21 may be easily arranged on the support member 2 to accommodate the direction of the desired subsequent bends and/or offsets d in view of the previously made bends and/or offsets d in the conduit 21.

After use, the shoes 10, the shoe attachment members 16, the shims 17, and the plurality of springs 19 may be stored in the storage container 4.

Figure 7:
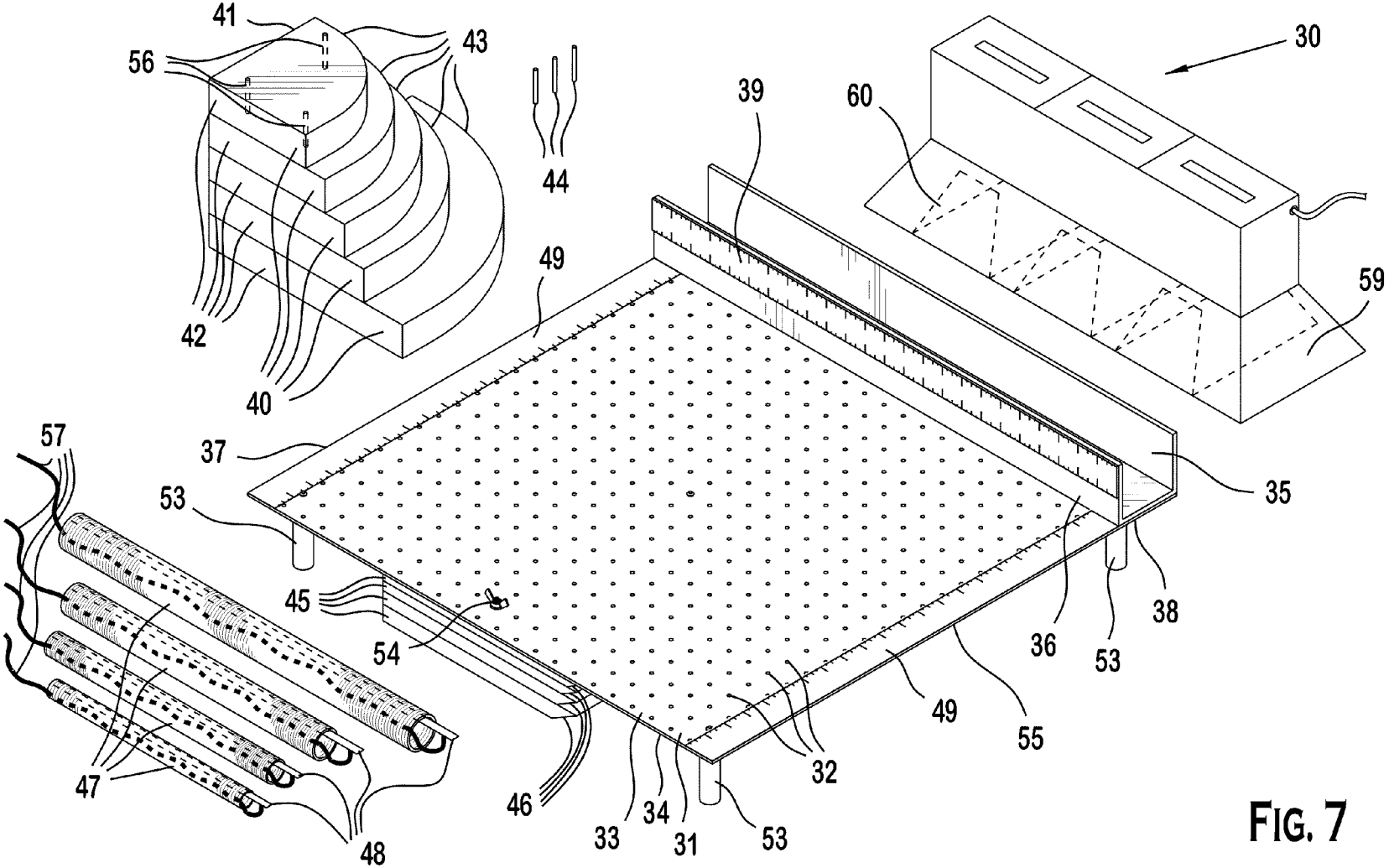
FIG. 7 is a top perspective view of a portable conduit bending frame assembly according to a second embodiment of the invention.
Figure 8:
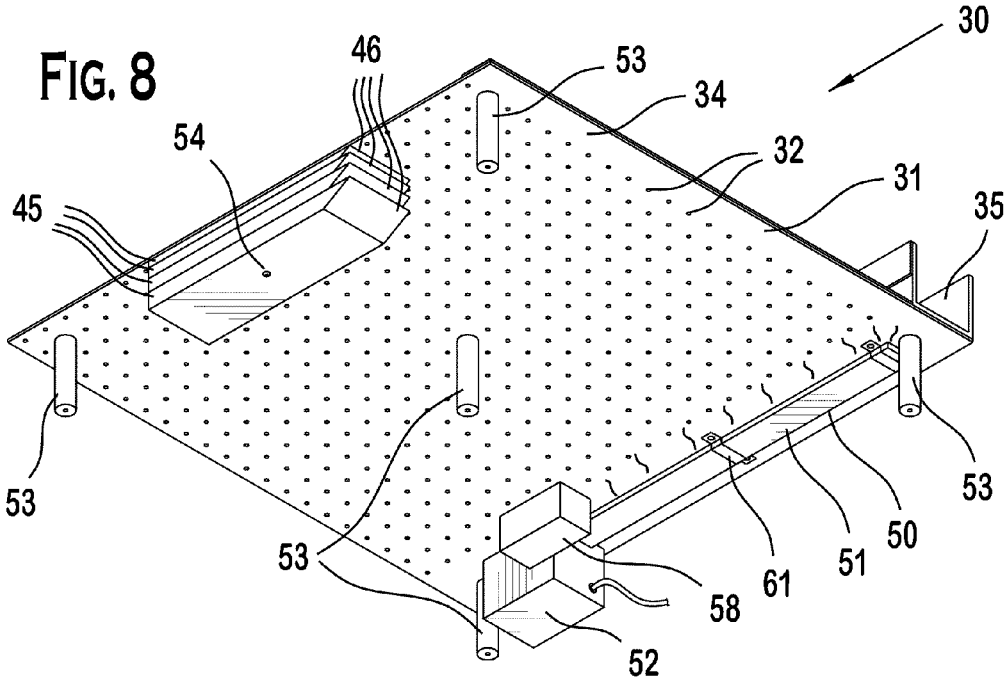
FIG. 8 is a bottom perspective view of the portable conduit bending frame assembly of FIG. 7.

FIGS. 7-12 show a portable conduit bending frame assembly 30 according to a second embodiment of the invention. As shown in FIGS. 7-8, the portable conduit bending frame assembly 30 includes a support member 31, a conduit holder 35, a plurality of shoes 40, a plurality of shoe attachment members 44, a plurality of shims 45, a plurality of springs 47, a pre-heating device 50, and a heating device 59. Each of the individual elements of the bending frame assembly 30 will now be described in greater detail.

As shown in FIG. 7, the support member 31 is substantially rectangular and is provided with a plurality of apertures 32. The support member 31 may be formed, for example, from a conductive material, such as aluminum, aluminum cast, or plate. The support member 31 includes a top surface 33, a bottom surface 34, first and second alignment ends 37, 55, respectively, and a conduit receiving end 38. The first and second alignment ends 37, 55 extend substantially perpendicular to the conduit receiving end 38. The first and second alignment ends 37, 55 extend in a direction of length of the support member 31, and the conduit receiving end 38 extends in a direction of width of the support member 31. The length of the support member 31 may be, for example, about 24 inches and the width of the support member 31 may be, for example, about 24 inches. Support legs 53 extend from the bottom surface 34 of the support member 31, as shown in FIG. 8.

As shown in FIG. 7, the conduit holder 35 is mounted to the top surface 33 of the conduit receiving end 38 of the support member 31. The conduit holder 35 is substantially U-shaped and extends the approximate width of the support member 31. One side of the conduit holder 35 is formed as a conduit support surface 36. The conduit support surface 36 extends the approximate length of the support member 31 and is positioned substantially parallel thereto. The conduit holder 35 may be formed, for example, from a conductive material, such as aluminum.

As shown in FIG. 7, a first conduit measuring device 39 is provided on the conduit support surface 36. The first conduit measuring device 39 extends the approximate width of the support member 31. The first conduit measuring device 39 may have, for example, units of measurement that measure from the first alignment end 37 to the second alignment end 55 and/or from the second alignment end 55 to the first alignment end 37. Second conduit measuring devices 49 extend substantially perpendicular to the first conduit measuring device 39 along an edge of the support member 31 along the first and second alignment ends 37, 55. The second conduit measuring devices 49 extend the approximate length of the support member 31. The first and second conduit measuring devices 39, 49 may be, for example, be provided with units if measurement, such as notches, metric units, English units, etc.

As shown in FIG. 7, each of the shoes 40 has first and second alignment surface 41, 42, respectively. The first alignment surface 41 extends substantially perpendicular to the second alignment surface 42. A conduit bending surface 43 extends between the first surface 41 and the second surface 43. The conduit bending surface 43 has a substantially arcuate configuration. The first and second alignment surfaces 41, 42 and the conduit bending surface 43 are formed to have a desired dimension. The substantially arcuate configuration of the conduit bending surface 43 may be, for example, the minimum arcuate configuration specified by the national electric code. For example, the shoes 40 may have a radius of between about 5 inches and 17 inches, however, other dimensions are possible. In the illustrated embodiment, a plurality of the shoes 40 are provided, which each have a different dimension.

Shoe attachment member receiving openings 56 are formed in the shoes 40 and extend from a bottom surface to a top surface thereof. The shoe attachment member receiving openings 56 are arranged a distance from the first and second alignment surfaces 41, 42 and the conduit bending surface 43 of the shoe 10. The shoe attachment member receiving openings 56 correspond to the apertures 32 of the support member 31. Each of the shoes 40 may be formed with a plurality of weight reducing openings (not shown) that extend between the top surface and the bottom surface of the shoes 40. The weight reducing openings (not shown) provide for easier handling when positioning and removing the shoes 10. The shoes 40 may be formed, for example, from wood, aluminum, fiberglass, etc.

As shown in FIG. 7, the shoe attachment members 44 are substantially cylindrical and correspond to the shoe attachment member receiving openings 56 of the shoes 40 and the apertures 32 of the support member 31. The shoe attachment members 44 have a length such that a portion of the shoe attachment members 44 extends from the top and the bottom surface of the shoes 40. It will be appreciated by those skilled in the art that the shoe attachment members 44 may alternatively be formed integrally with the shoes 40 or the support member 31. The shoe attachment members 44 may be formed, for example, from wood, aluminum, fiberglass, or a heat tolerant material.

As shown in FIG. 8, the shims 45 are substantially rectangular in shape and have at least one beveled end 46. The beveled ends 46 are formed to have a desired dimension. In the illustrated embodiment, a plurality of the shims 45 are provided, which each have a different thickness and beveled ends of different angular dimensions. The shim 45 may, for example, have a thickness of between about ⅛ inch and ¾ inch, however, other dimensions are possible. The shims 45 may be attached to the bottom surface 34 of the support member 31 by an attachment mechanism 54 that extends through the apertures 32. The shims 45 may be formed, for example, from wood, aluminum, fiberglass, sheet felt, etc.

As shown in FIG. 7, the springs 47 are substantially elongated in shape and are formed to have an external dimension and length. In the illustrated embodiment, a plurality of the springs 47 are provided, which each have a different external dimension and length. A tape 48 may be woven through a first end of the spring 47. A pulling member 57, such as a steel fish tape, may be attached to the tape 48. In the illustrated embodiment, the pulling member 57 is fed through the spring 47 such that the pulling member 57 extends from the second end of the spring 47. Alternatively, the pulling member 57 may be directly attached to the first end of the spring 47. It will be appreciated by those skilled in the art that structures other than springs 47 may also be provided.

As shown in FIG. 7, the heating device 59 is substantially rectangular in shape and has a length substantially corresponding to the width of the support member 31. The heating device 59 is provided with a plurality of radiation elements 60 that radiate heat toward a heat emitting surface of the heating device 59. The radiation elements 60 may be, for example, a plurality of 500 Watt halogen heat strip bulbs. It will be appreciated by those skilled in the art, however, that the wattage of the halogen heat strip bulbs may vary depending of the desired speed of heating. The radiation elements 60 may also be individually controlled. A metal guard (not shown) may be provided between the radiation elements 60 and the heat emitting surface of the heating device 59. The heating device 59 may be any of a variety of conventional heating devices that is portable and is capable of radiating heat.

As shown in FIG. 8, the pre-heating device 50 is mounted to the bottom surface 34 of the conduit receiving end 38 of the support member 31. The pre-heating device 50 includes an elongated heating strip or contact heater 51 and an electrical box 52. The heating strip 51 extends substantially the width of the support member 31 and is mounted directly beneath the conduit holder 35 and in contact with the support member 31, which prevents the support member 31 from warping when the support member 31 is heated. A bracket 61 may be mounted over the heating strip 51 to prevent sagging of the heating strip 51. The heating strip 51 may be, for example, a 300 Wattflat coil operating at about 175-190 degrees Fahrenheit, which may or may not be individually controlled by a contact thermostat 58. The heating strip 51 may be, for example, a CHROMALOX strip heater. The pre-heating device 50 may be any of a variety of conventional heating devices that is capable of radiating heat.

A method of bending the conduit 21 using the portable conduit bending frame assembly 30 according to the second embodiment of the invention will now be described with reference to FIGS. 9-12.

Figure 9:
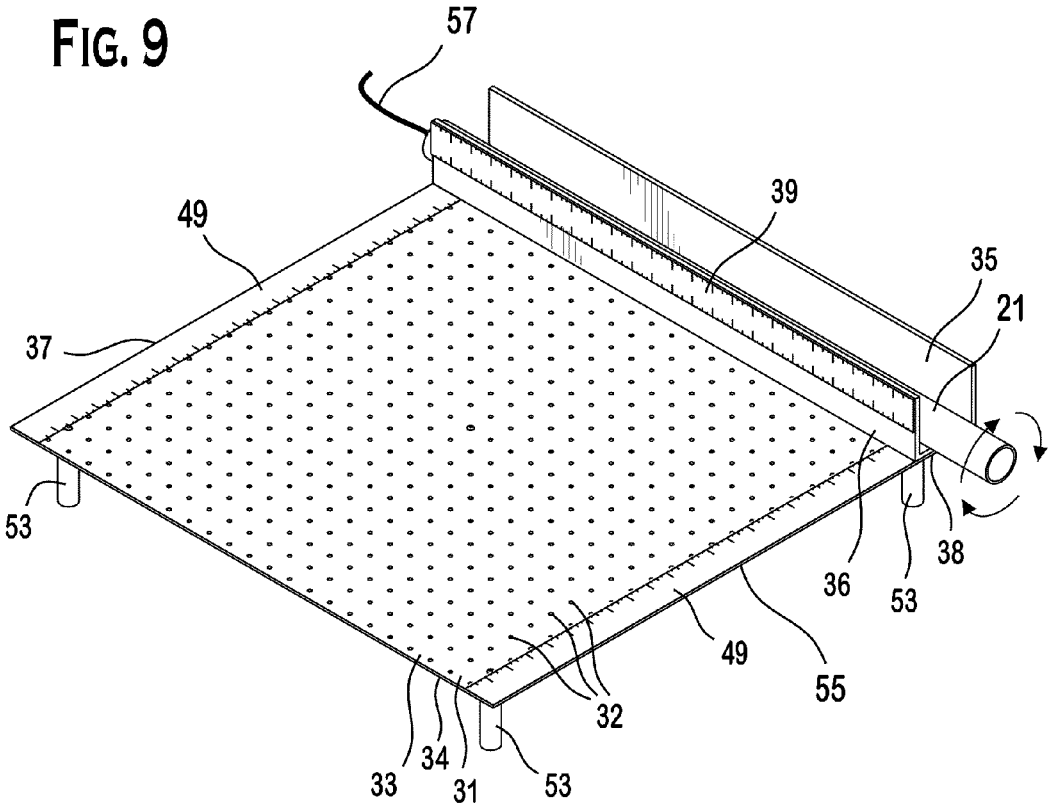
FIG. 9 is a perspective view of a first step in a method of bending a conduit using the portable conduit bending frame assembly of FIG. 7.
Figure 10:
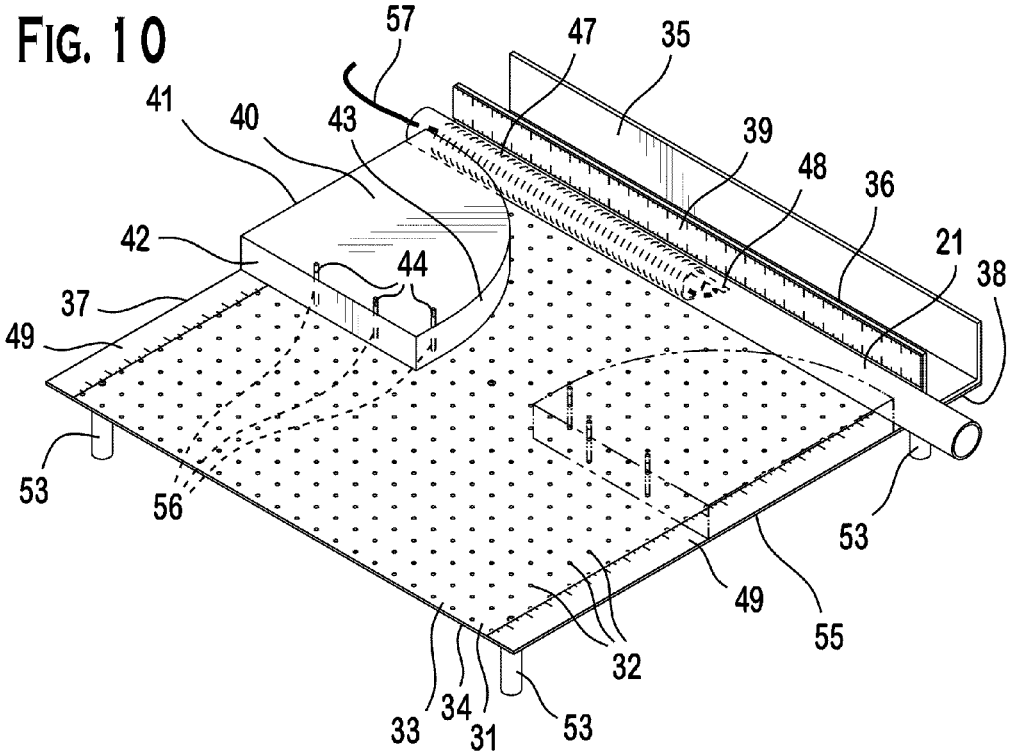
FIG. 10 is a perspective view of a second step in the method of bending the conduit using the portable conduit bending frame assembly of FIG. 7.

As shown in FIGS. 9-10, one of the springs 47 is inserted into the conduit 21 such that the pulling member 57 protrudes from an end of the conduit 21 opposite from the tape 48. A lubricant (not shown), such as liquid soap or a non-stick spray, may be applied to the spring 47 and/or the conduit 21 before insertion of the spring 47 into the conduit 21. The external dimension and length of the spring 47 substantially corresponds to an internal dimension and length of the conduit 21. The conduit 21 is positioned on the conduit receiving end 38 of the support member 31 inside the conduit holder 35 such that the conduit 21 extends in the direction of length of the support member 31. The heating strip 51 of the pre-heating device 50 applies heat to the conduit 21 to pre-heat the conduit 21. The pre-heating device 50 is particularly useful in cold environments to pre-heat the conduit 21 prior to heating with the heating device 59. As the conduit 21 is pre-heated, the conduit 21 may be periodically rotated in a direction of the arrows shown in FIG. 9. Because the spring 47 is provided inside the conduit 21, the spring 47, which conducts heat, contributes to heating the conduit 21. When it is time to form or bend the conduit 21, the pre-heated conduit 21 is removed from the holder 35 of the support member 31 and is positioned against the support surface 36 of the holder 35 such that the conduit 21 extends in the direction of length of the support member 31, as shown in FIG. 10.

Similar to the heating device 20 of the first embodiment shown in FIG. 2, the heat emitting surface of the heating device 59 is positioned proximate the conduit 21 such that the radiation elements 60 radiate heat toward the conduit 21. The metal guard (not shown) of the heating device 59 may optionally be positioned such that the metal guard (not shown) is in contact with the conduit 21. As the conduit 21 is heated, the conduit 21 is periodically rotated in a direction of the arrows shown in FIG. 2 until the conduit 21 is heated to a temperature where it is substantially rubbery and/or capable of being bent with no or minimal resistance. Because the spring 47 is provided inside the conduit 21, the spring 47, which conducts heat, contributes to heating the conduit 21. Once the conduit 21 has been heated, the heating device 59 is removed from the support member 31. It will be appreciated by those skilled in the art that the pre-heating device 50 may alternatively be used to heat the conduit 21 to a temperature where it is substantially rubbery and/or capable of being bent with no or minimal resistance if so configured without the assistance of the heating device 59.

As shown in FIG. 10, at least one of the shoes 40 is attached to the support member 31. The shoe attachment members 44 are inserted into a plurality of the apertures 32 of the support member 31. The shoe 40 is attached to the support member 31 by aligning the first alignment surface 41 of the shoe 40 substantially parallel to the alignment end 37 of the support member 31 such that the conduit 21 is sandwiched between the conduit bending surface 43 of the shoe 40 and the support surface 36 of the holder 35. Alternatively, the shoe 40 may be attached to the support member 31 by aligning the first alignment surface 41 of the shoe 40 substantially parallel to the second alignment end 55 of the support member 31 such that the conduit 21 is sandwiched between the conduit bending surface 43 of the shoe 40 and the support surface 36 of the holder 35, as shown in phantom in FIG. 10. The shoe attachment members 44 are received in the shoe attachment member receiving openings 56 of the shoe 40 to fix the shoe 40 relative to the support member 31.

Figure 11:
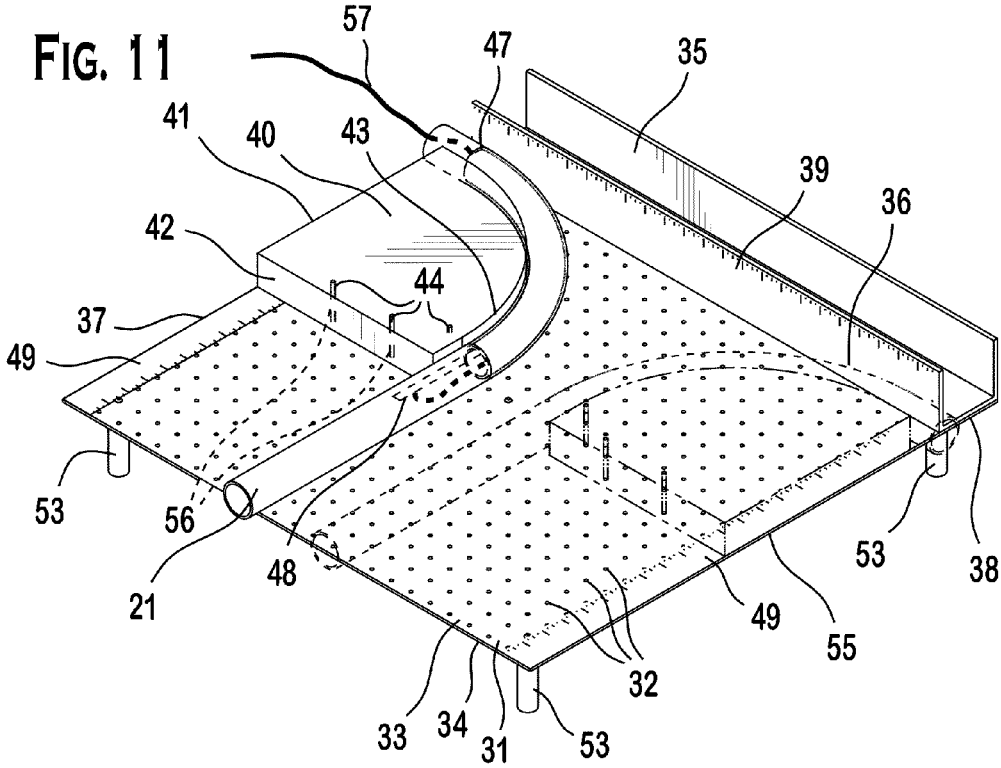
FIG. 11 is a perspective view of a third step in the method of bending the conduit using the portable conduit bending frame assembly of FIG. 7.

As shown in FIG. 11, an end of the conduit 21 positioned farthest from the shoe 40 is pulled away from the support surface 36 such that the conduit 21 is bent about the conduit bending surface 43. The conduit 21 is bent until the conduit 21 concentrically embraces the substantially arcuate configuration of the conduit bending surface 43 of the shoe 40. Because the spring 47 is provided inside the conduit 21, the spring 47 prevents the internal dimension of the conduit 21 from constricting or deforming when the conduit 21 is bent about the conduit bending surface 43 of the shoe 40. Once the conduit 21 is bent to the desired configuration, the conduit 21 is allowed to cool and is then removed from the support member 31.

The spring 47 is removed from the conduit 21 by pulling on the pulling member 57 protruding from the end of the conduit 21. Because the tape 48 is attached to the first end of the spring 47 and the pulling member 57, which is attached to the tape 48, extends from the second end of the spring 47, the spring 47 is prevented from stretching when the spring 47 is pulled from the conduit 21.

Figure 12:
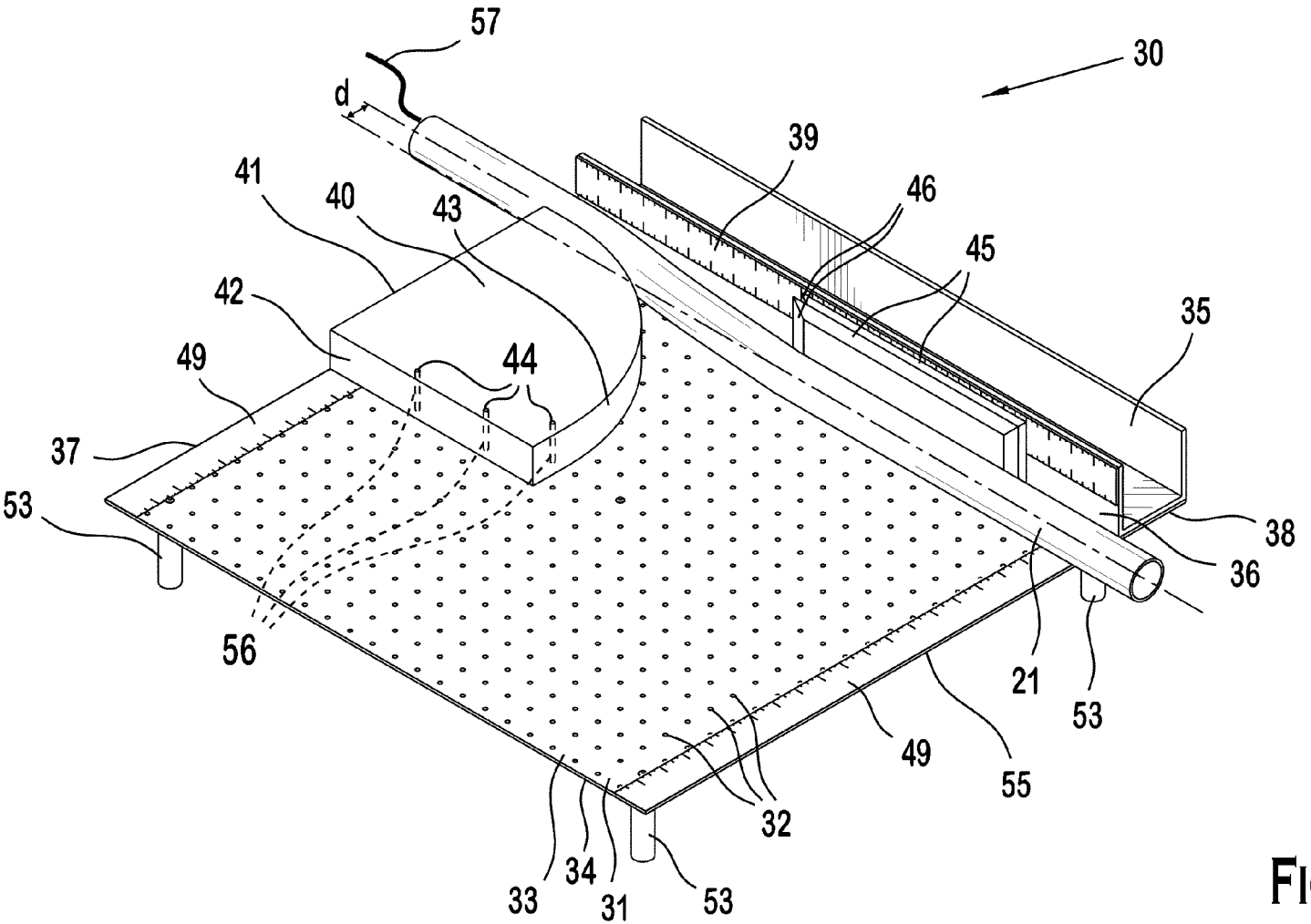
FIG. 12 is a perspective view of a second method of bending the conduit using the portable conduit bending frame assembly of FIG. 7.

FIG. 12 shows a second method of bending the conduit 21. As shown in FIG. 12, after the conduit 21 is heated to a temperature where it is substantially rubbery and/or capable of being bent with no or minimal resistance, at least one of the shims 45 may be positioned substantially parallel to and against the support surface 36 of the holder 35 such that the beveled edges 46 extend in a direction of a desired offset d in the conduit 21. In the illustrated embodiment two of the shims 45 are positioned substantially parallel to and against the support surface 36 of the holder 35. The conduit 21 is removed from the holder 35 of the support member 31 and is positioned against the support surface 36 of the holder 35 such that the conduit 21 extends in the direction of width of the support member 31 and is positioned against the shims 45.

The shoe 40 is attached to the support member 31 by aligning the first alignment surface 41 of the shoe 40 substantially parallel to the first alignment end 37 of the support member 31 such that the conduit 21 is sandwiched between the conduit bending surface 43 of the shoe 40 and the support surface 36 of the holder 35. The shoe attachment members 44 are received in the shoe attachment member receiving openings 56 of the shoe 40 to fix the shoe 40 relative to the support member 31. As a result of the conduit 21 being partially bent about the conduit bending surface 43 and engaging with the beveled edges 46 of the shims 45, the offset d is formed in the conduit 21.

Figure 13:
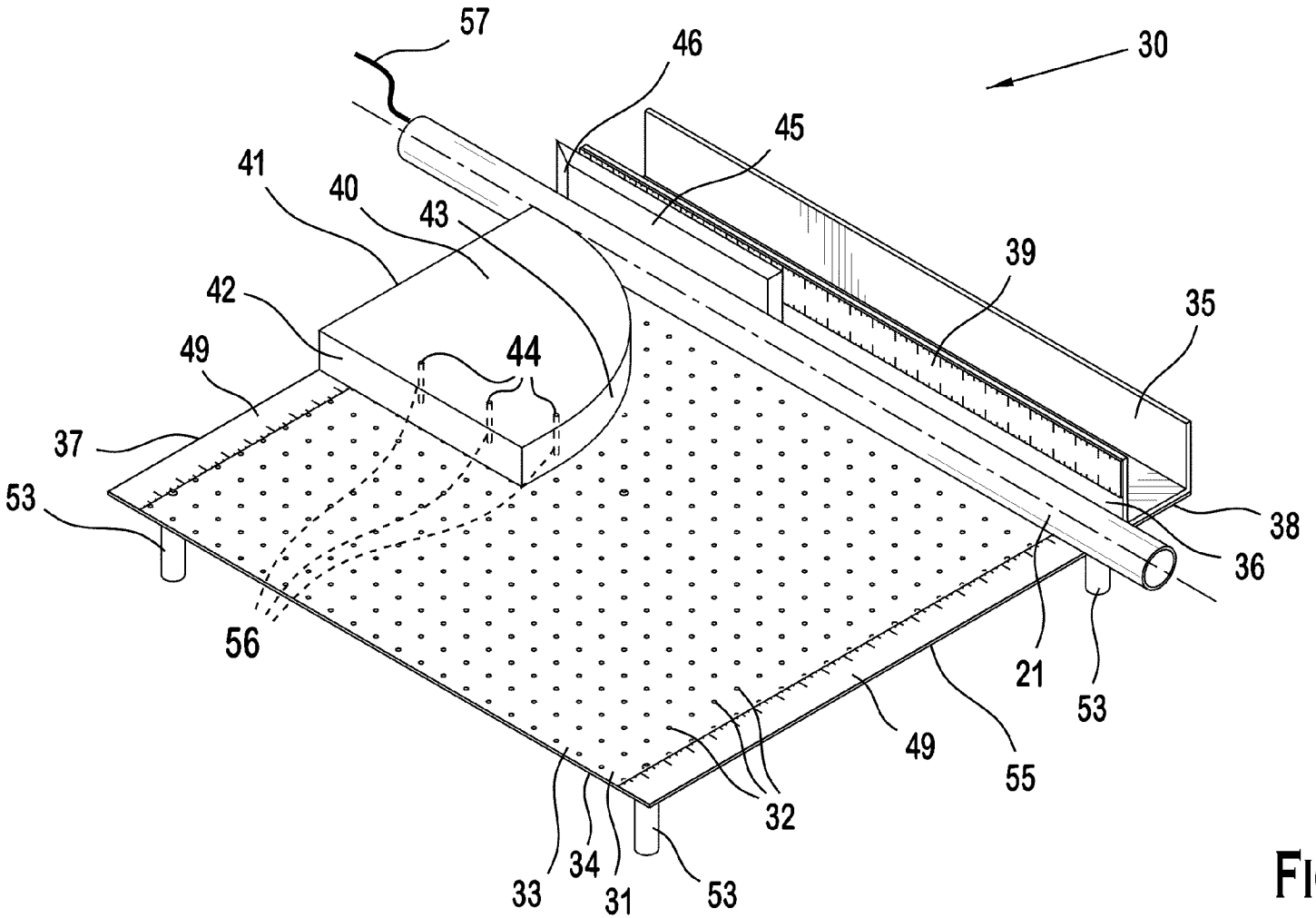
FIG. 13 is a perspective view of a third method of bending the conduit using the portable conduit bending frame assembly of FIG. 7.

FIG. 13 shows a third method of bending the conduit 21. As shown in FIG. 13, at least one of the shims 45 may be positioned against the support surface 36 and substantially above the shoe 40. The conduit 21 is positioned between the conduit bending surface 43 of the shoe 40 and the shim 45. The conduit 21 is then bent to form a bend in the conduit 21 when the shoe 40 provided to bend the conduit 21 is configured for a conduit having a larger diameter than the diameter of the conduit 21 desired to be bent. As a result, each of the shoes 40 can be used to bend the conduits 21 regardless of their diameters.

Although the conduit 21 is only illustrated as being formed with a single bend or offset d, it will be appreciated by those skilled in the art that the conduit 21 may be formed to have a plurality of bends and/or offsets d. Additionally, because the first conduit measuring device 39 may have, for example, units of measurement that measure from the first alignment end 37 to the second alignment end 55 and from the second alignment end 55 to the first alignment end 37, the conduit 21 may be easily arranged on the support member 31 to accommodate the direction of the desired subsequent bends and/or offsets d in view of the previously made bends and/or offsets d in the conduit 21.

Figure 14:
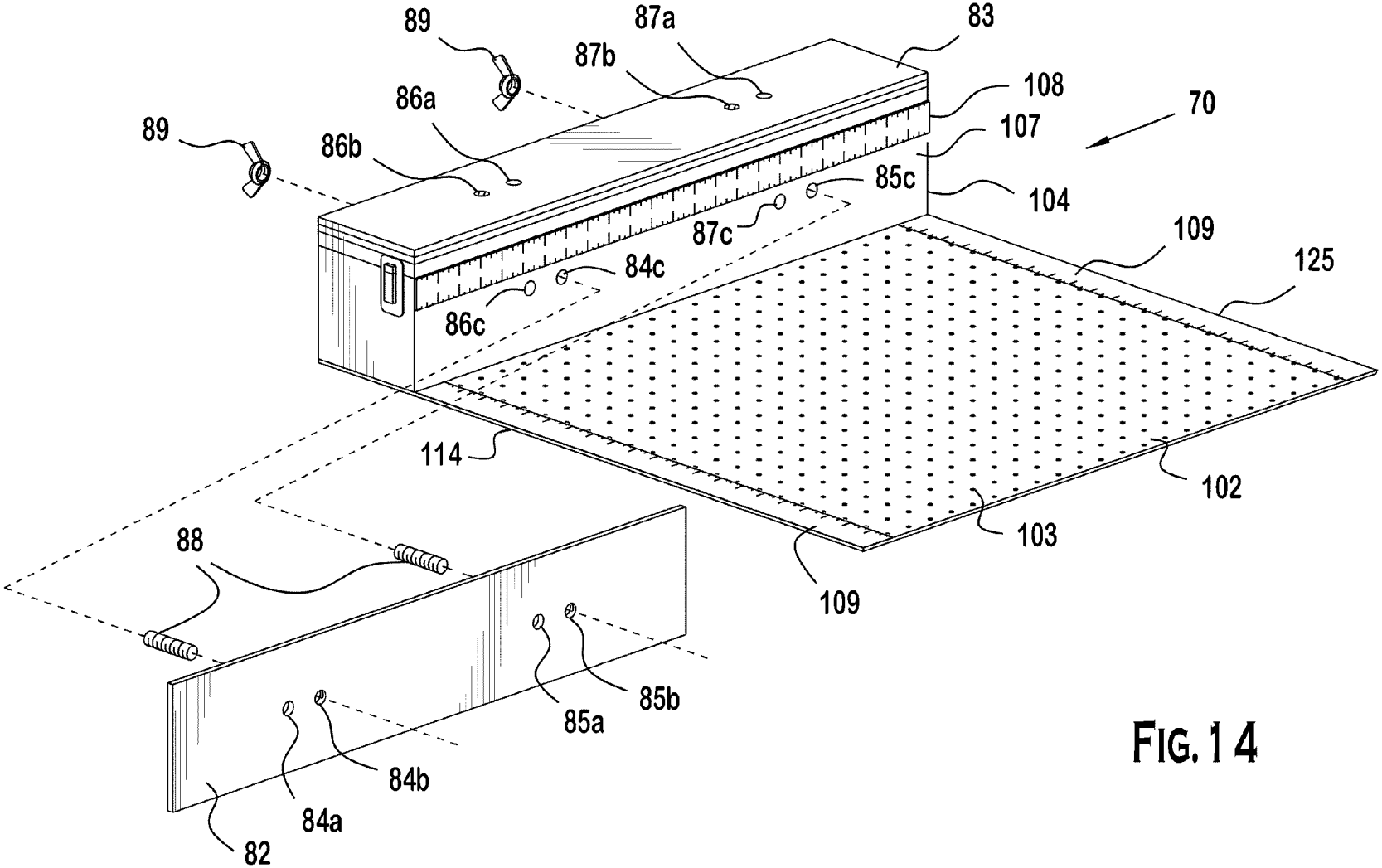
FIG. 14 is an exploded prospective view of a portable conduit bending frame assembly according to a third embodiment of the invention

FIG. 14 shows a portable conduit bending frame assembly 70 according to a third embodiment of the invention which illustrates schedule spacers 82, 83 and method for correcting the space between the support surface 107 and the conduit 21 for different schedules of the conduit 21. The support member 102 with a plurality of the apertures 103 is set up for schedule 80 conduit in this embodiment. Two schedule spacers 82, 83 are provided, which each have a different thickness. One schedule spacer 82, when inserted, configures the assembly 70 for schedule 40 conduit, the other schedule spacer 83, when inserted, configures the assembly 70 for schedule 20 conduit. However, other dimensions of the schedule spacers 82, 83 are possible to configure the assembly 70 for any schedule conduit or any conduit having a different wall thickness. As shown in FIG. 14, the schedule spacers 82, 83 are substantially rectangular in shape and are provided with the holes 84*a*, 84*b*, 85*a*, 85*b* in the schedule spacer 82 and 86*a*, 86*b*, 87*a*, 87*b* in the schedule spacer 83, respectively. The schedule spacers 82, 83 may be attached to the cover 105 of the storage container 104. The cover 105 includes holes 84*d*, 85*d*, 86*d*, 87*d* (not shown) which are positioned in the cover 105 in a similar way to the holes 84*c*, 85*c*, 86*c*, 87*c* in the support surface 107. The holes 84*a*, 85*a* in the schedule spacer 82 or the holes 86*a* and 87*a* in the schedule spacer 83 are arranged to anchor the schedule spacers 82, 83, respectively, to the cover 105 for carrying if both spacer plates 82, 83 are not needed. FIG. 14 also shows mounting studs 88 fixed in the holes 84*b*, 85*b* in the schedule spacer 82 by welding or other suitable attachment means. Wing-nuts 89 secure the schedule spacer 82 for the schedule 40 to the conduit support surface 107 through the hole 84*c*, 85*c* on the supporting surface 107 as well as anchor the schedule spacer 82 on the cover 105 in carrying position through the holes 84*d*, 85*d* in the cover 105. Similarly, the schedule spacer 83 is secured on the support surface 107 with mounting studs 88 fixed in the holes 86*b*, 87*b* in the schedule spacer 83 by welding or other suitable attachment means. Wing-nuts 89 behind the support surface 107, anchor the schedule spacer 83. Each schedule spacer 82, 83 therefore has studs 88 fixed thereto in the holes 84*b*, 85*b*, 86*b*, 87*b* and holes 84*a*, 85*a*, 86*a*, 87*a* positioned adjacent to each stud 88 in order to allow studs 88 of the other schedule spacer 82, 83 to pass through holes 84*a*, 85*a*, 86*a*, 87*a* when they are stacked on the cover 105 in carrying position regardless of which schedule spacer is on the top of the other one. It should be noted here that the holes 84*a*, 85*a*, 86*a*, 87*a* should be sufficiently spaced from the holes 84*b*, 85*b*, 86*b*, 87*b* where the studs 88 are mounted to allow clearance for the wing-nuts 89. In addition, the schedule spacers 82, 83 may be formed, for example, from wood, aluminum, fiberglass, etc.

Two measuring devices 108 are on the top portion of the conduit support surface 107 and shown on the top of the schedule spacers 82, 83 when they are is in use. Sliding scales 109 extend substantially perpendicular to the measuring devices 108 along the first and the second alignment ends 114, 125 and correct for schedule spacers 82, 83 when in use. It should be understood that there are variations of sliding scales 109 on the surface member 102. Sliding scale 109 can be combined with multiple different scales aggregated together for different schedules, or a different scale attached, for example, with tacky chemical materials, on the top of the other scale for a different schedule, or a scale defined with different units of measurements, or any other possible means of adjusting the scale. When a conduit with schedule 40 is presented on the support member 102, the schedule spacer 82 is attached to the support surface 107, similarly, when a conduit with schedule 20 is presented on the support member 102, the schedule spacer 83 is attached to the support surface 107. Other elements in this illustrated embodiment and a method of bending a conduit are the same as those of the bending frame assembly 1 and their descriptions can be referred to in the description of the bending frame assembly 1 above.

Figure 15:
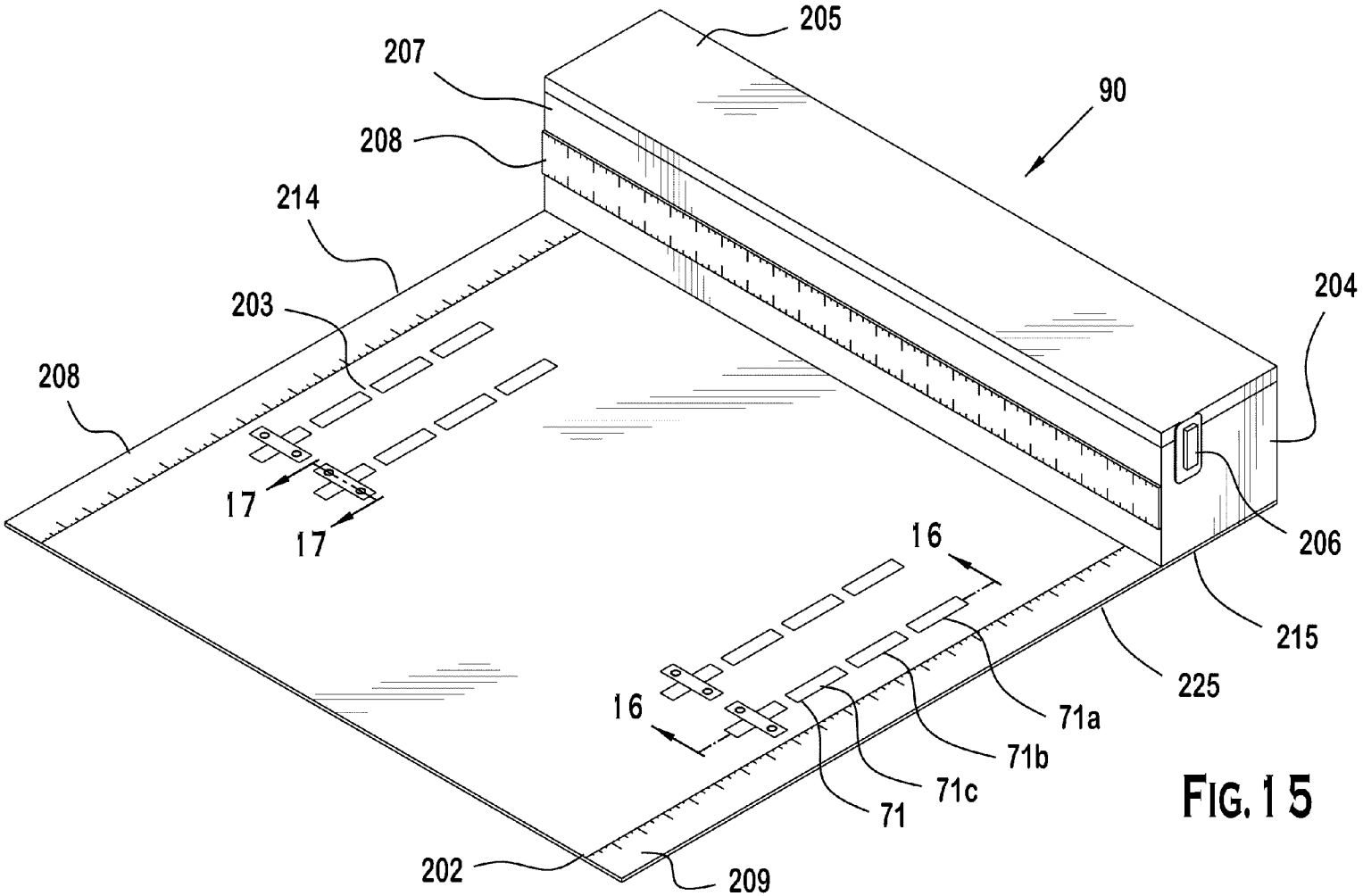
FIG. 15 is a top perspective view of a portable conduit bending frame assembly according to a fourth embodiment of the invention.
Figure 16:
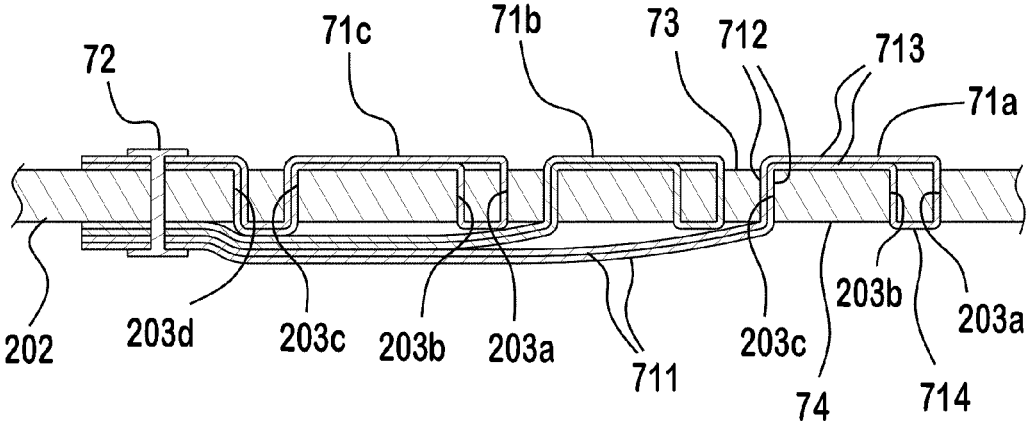
FIG. 16 is a sectional view taken along the line E-E of FIG. 15.
Figure 17:
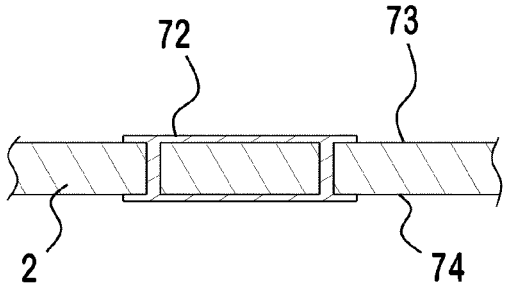
FIG. 17 is a sectional view of attachment strips taken along the line F-F of FIG. 15.
Figure 18:
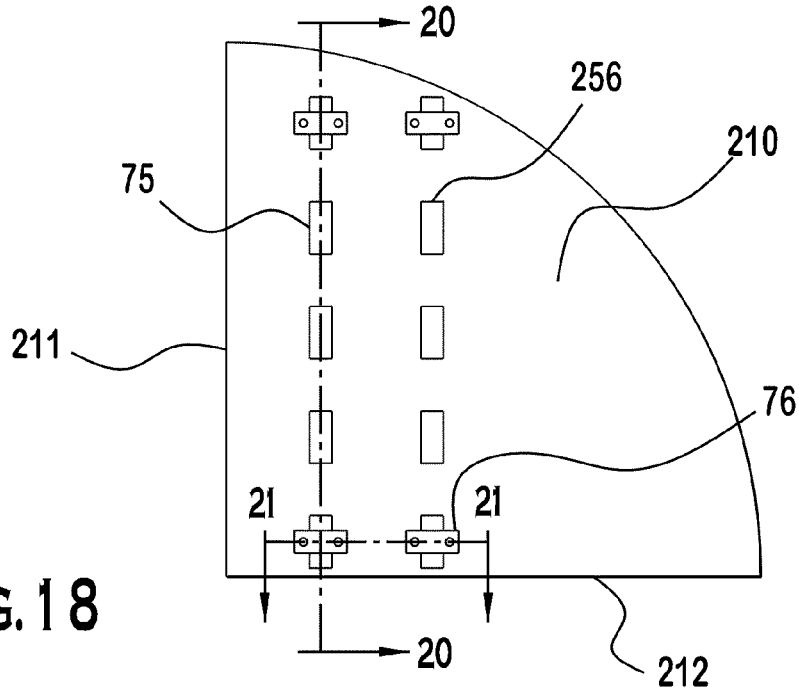
FIG. 18 is a top view of one configuration of the shoes according to a fourth embodiment of the invention.
Figure 19:
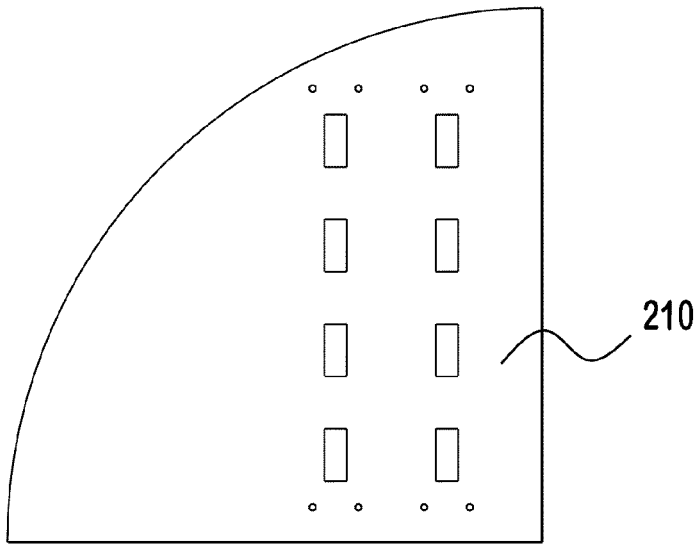
FIG. 19 is a bottom view of one configuration of the shoes according to a fourth embodiment of the invention.

FIGS. 15-17 show a portable conduit bending frame assembly 90 according to a fourth embodiment of the invention which illustrates a second method of attaching the shoes 210 on the support member 202. As shown in FIG. 15, the support member 202 is modified to remove the apertures 3 in the bending frame assembly 1 and provided with attachment strips 71 fixed in a direction parallel to the second conduit measuring device 209 through a plurality of slits 203, where the first two attachment strips 71 are fixed on the support member 202 close to the side of the first alignment end 214 of the support member 202 and the second two attachment strips are fixed on the support member 202 close to the side of the second alignment end 225. It should be noted that the spacing of the attachment strip 71 to the alignment ends 214, 225 should be such that the attachment strips 71 mate with all of the various size shoes 210 as shown in FIG. 18. It should also be noted that it is not necessary for the entire surface area of shoe attachment strips 75 shown in FIG. 18 to engage the attachment strips 71 on the support member 202. A partial engagement of attachment strips 71, 75 is sufficient to hold the shoe in place on the support member 202. FIGS. 16 and 17 show how the attachment strips 71 attach to the support member 202, which includes a plurality of slits 203 in the support member 202 and a plurality of the attachment strips 71 on the support member 202. In the illustration of the embodiment, the slits 203 formed in the support member 202 are substantially rectangular narrow slits that fit the thickness of the attachment strips 71 and extended from the top surface 73 of the support member 202 to the bottom surface 74 of the support member 202. The longer side of the slits 203 are substantially perpendicular to the first and second alignment ends 214, 215. As shown in FIG. 16, slit 203*a* is formed in the right side of the sectional view taken along the line E-E of the embodiment, slit 203*b* is formed in a short distance away on the left side of slit 203*a* and slit 203*c* is formed in a longer distance than the distance between 203*a* and 203*b* away on the left side of the slit 203*b*. Each attachment strips 71 includes tail portions 711, insertion portions 712, top portion 713 and bottom portion 714. The attachment strips 71*a*, 71*b* are formed on the support member 202 in a same means that the tail portions 711 of the attachment strips 71*a*, 71*b* are on the bottom surface 74 of the support member 202, while the attachment strip 71*c* is configured with one more slit 203*d* formed in a short distance in the left side of a slit 203*c*, which results in the tail potions 711 of the attachment strip 71*c* being located on the top surface 73 of the support member 202. As shown in FIG. 16, the tail portions 711 of the attachment strips 71 are clamped with the clamp 72 in the left side of the sectional view taken along the line E-E of the embodiment. It should be understood that clamp 72 can be a stainless steel clamp or any other clamps or fastener which can fix the attachment strips 71 on the top surface 73 and the bottom surface 74 of the support member 202. With this arrangement, each attachment strip 71 passes through the support member 202 multiple times as shown to facilitate securing it to the support member 202. The top portion 713 of each attachment strip 71 on the support member 202 is substantially longer than the bottom portion 714 on the bottom surface 74 of the support member 202 to increase the surface area which will contact the complementary attachment strip 75 as will be described below. Attachment strips 71 may be provided with the strips mechanically or chemically formed to temporally fix the shoe 210 on the support member 202, for example, Velcro strips, tacky adhesive strips, magnetic strips, etc. It should be understood that the attachment strips 71, while show here to have certain dimensions, may be alternatively formed in other dimensions up to and including dimensions which would cover the entire top surface 73. It should also be noted here that while the attachment strips 71 are, in this embodiment, secured to the support member 202 in a certain undulating pattern over the top and bottom 73,74, other patterns and methods of securing the attachment strips 71 are anticipated by the invention. Such patterns may extend longer or shorter distances from the conduit support surface 207.

Figure 20:
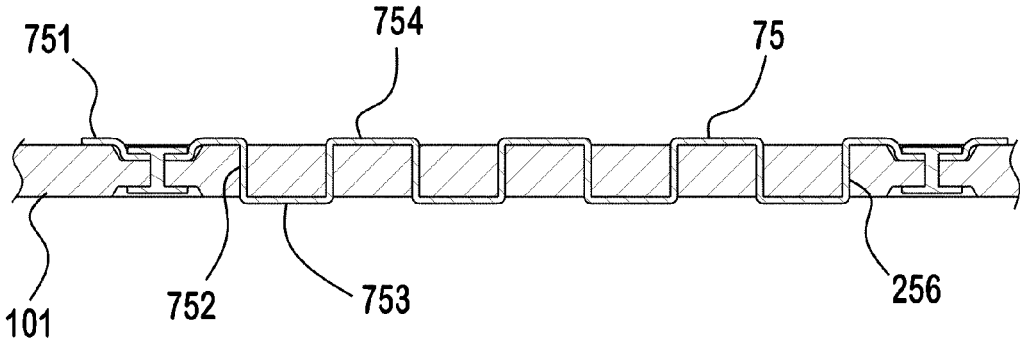
FIG. 20 is a sectional view of another configuration of the shoes taken along the line A-A of FIG. 18.
Figure 21:
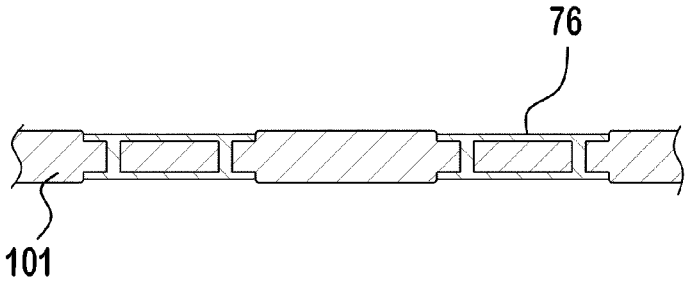
FIG. 21 is a sectional view of another configuration of the shoes taken along the line B-B of FIG. 18.
Figure 22:
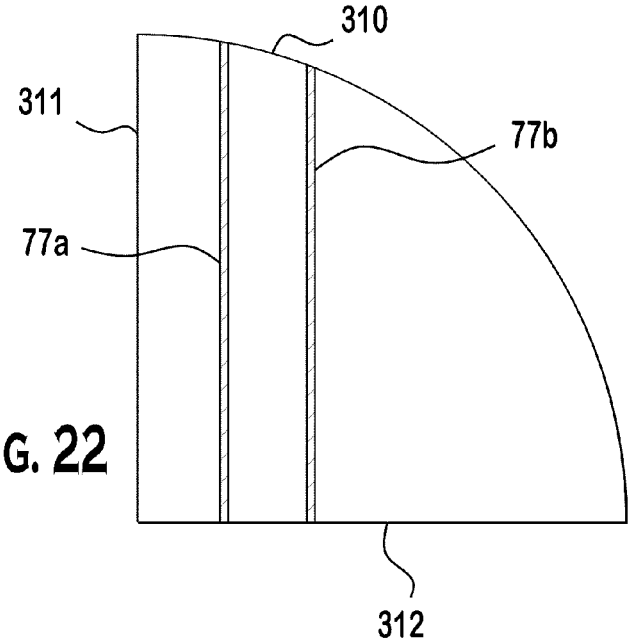
FIG. 22 is a top view of another configuration of the shoes according to a fourth embodiment of the invention.
Figure 23:
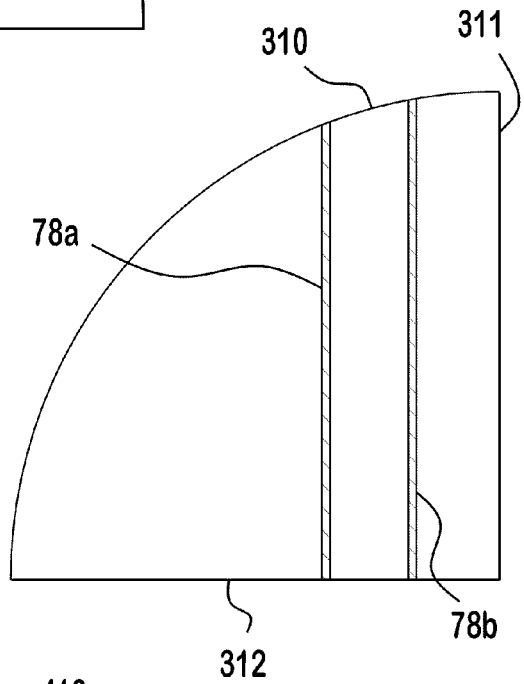
FIG. 23 is a bottom view of another configuration of the shoes according to a fourth embodiment of the invention.
Figure 24:
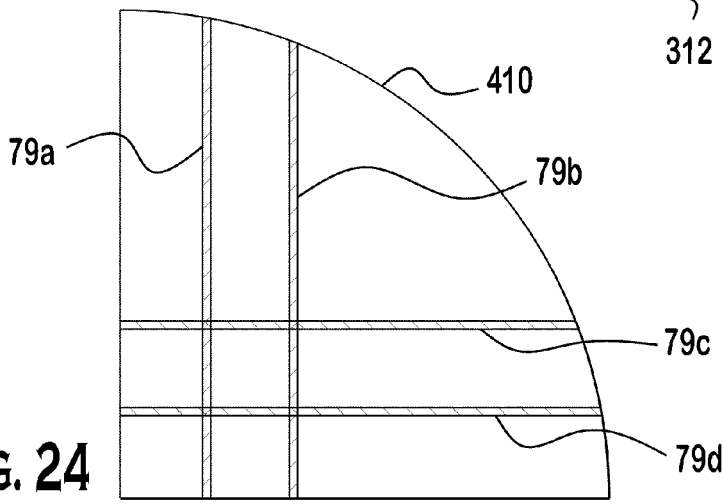
FIG. 24 is a bottom view of another configuration of the shoes according to a fourth embodiment of the invention.

FIGS. 18-24 show different arrangements of attachment strips on the shoe of a portable conduit bending frame assembly 90 according to a fourth embodiment of the invention which illustrates a second method of attaching the shoe on the support member 202. As shown in FIGS. 18-21, the shoe 210 includes a plurality of slits 256 extended from a top surface to a bottom surface of the shoe 210 and formed as rows with substantial even space in a direction parallel to a alignment surface 211 and a plurality of the attachment strips 75 on the top and bottom surfaces of the shoes 210. As shown in FIG. 20, the top and bottom surfaces are each a major surface of the shoe 210. Attachment strips 75 include tail portions 751, insertion portions 752, bottom portions 753 and top portion 754. The top portion 754 of the attachment strips 75 on the shoe 210 are substantially equal to the bottom portion 753 of the shoe 210 on the bottom surface. Attachment strips 75 may be provided with the strips mechanically or chemically formed that can temporally fix the shoe 210 on the support member 202, for example, Velcro strips, tacky adhesive strips, magnetic strips, etc. are a few non-exclusive examples. The attachment strips 75 are double sided and undulate through the shoe 210 and the two ends of the double side attachment strips 75 are clamped on the shoe 210 with clamps 76. It should be understood that clamp 76 can be a stainless steel counter-top clamp or any other clamp which can fix the attachment strip 75 on the surface of the shoe 210 and maintain the surface flat. It should be understood that in all embodiments of the shoe, a single clamp could be utilized instead of two clamps. In the single clamp embodiment, the attachment strip may be wrapped around the edge of the shoe of otherwise woven back to the single clamp. In this illustrated embodiment, FIGS. 22-23 show the attachment strips 77, 78 fixed on the top and the bottom surfaces of the shoe 310, respectively, for bending and inverse bending. The attachment strips 77, 78 can also be glued on the surface of the shoe 310 or attached by other surface means. Note also that the strips 77,78 may take other shapes and dimensions. FIG. 24 shows attachment strips 79 crossly fixed on either top or bottom surface of the shoe 410 for bending and inverse bending. Other arrangements of the attachment strips are possible.

With the fourth embodiment of the claimed invention, at least one of the shoes 210, or 310, or 410 is attached to the support member 202. The attachment strips 75 or 77, or 78, or 79 of the shoe temporarily attached to the attachment strips 71 on the support member 202. A method of bending or inverse bending a conduit is the same as those of the bending frame assembly 1 and their descriptions can be referred to in the description of the bending frame assembly 1 above. In this embodiment, the shoe 210, 310, 410 is advantageously more flexibly and finely adjustable along the scale 209.

The portable conduit bending frame assemblies 1, 30, 70 and 90 according to the first, second, third and fourth embodiments of the invention are therefore easy to transport and operate and can economically heat and form or bend the conduit 21 to a desired configuration to obtain a conduit with a desired configuration without the use of couplings.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A portable conduit bending frame assembly, comprising:

a support member having a first alignment end, a second alignment end, and a first conduit measuring device that extends an approximate width of the support member, the support member having a flat conduit support surface fixed thereto, and extending substantially perpendicular to a top surface of the support member; the top surface having at least a portion of a first attachment strip located thereon;

a shoe having a first alignment surface extending substantially perpendicular to a second alignment surface, an arcuate conduit bending surface extending between the first and second alignment surfaces, and a complementary attachment strip extending at least partially on a major surface of the shoe; the conduit bending surface facing the conduit support surface, and the shoe being removably attachable to the top surface such that its first alignment surface can be aligned parallel with either alignment end of the support member; and a heating device arranged proximate the conduit support surface for heating a conduit prior to bending the conduit at least partially about the conduit bending surface.

2. The portable conduit bending frame assembly of claim 1 further comprising a plurality of openings in the support member through which the first attachment strip passes.

3. The portable conduit bending frame assembly of claim 1 further comprising a clamp for fixing the first attachment strip to the top surface of the support member.

4. The portable conduit bending frame assembly of claim 1 further comprising a shoe clamp for fixing the complementary attachment strip to the shoe.

5. The portable conduit bending frame assembly of claim 4 wherein the shoe clamp is recessed into the major surface.

6. The portable conduit bending frame assembly of claim 4 wherein the complementary attachment strip passes through openings in the major surface of the shoe.

7. The portable conduit bending frame assembly of claim 1 further comprising complementary attachment strips extending along top and bottom major surfaces of the shoe.

8. The portable conduit bending frame assembly of claim 1 wherein the complementary attachment strip extends from one of the alignment surfaces toward the arcuate conduit bending surface.

9. A portable conduit bending frame assembly, comprising:

a support member having a first alignment end, a second alignment end, and a first conduit measuring device that extends an approximate width of the support member, the support member having a flat conduit support surface fixed thereto, and extending substantially perpendicular to a top surface of the support member; the top surface having at least a portion of a first attachment strip located thereon;

a shoe having a first alignment surface extending substantially perpendicular to a second alignment surface, an arcuate conduit bending surface extending between the first and second alignment surfaces, and a complementary attachment strip extending at least partially on a major surface of the shoe; the conduit bending surface facing the conduit support surface, and the shoe being removably attachable to the top surface such that either of its alignment surfaces can be aligned parallel with either alignment end of the support member; and a heating device arranged proximate the conduit support surface for heating a conduit prior to bending the conduit at least partially about the conduit bending surface.

10. The portable conduit bending frame assembly of claim 9 further comprising a plurality of openings in the support member through which the first attachment strip passes.

11. The portable conduit bending frame assembly of claim 9 further comprising a clamp for fixing the first attachment strip to the top surface of the support member.

12. The portable conduit bending frame assembly of claim 9 further comprising a shoe clamp for fixing the complementary attachment strip to the shoe.

13. The portable conduit bending frame assembly of claim 12 wherein the shoe clamp is recessed into the major surface.

14. The portable conduit bending frame assembly of claim 12 wherein the complementary attachment strip passes through openings in the major surface of the shoe.

15. The portable conduit bending frame assembly of claim 9 further comprising complementary attachment strips extending along top and bottom major surfaces of the shoe.

16. The portable conduit bending frame assembly of claim 9 wherein the complementary attachment strip extends from one of the alignment surfaces toward the arcuate conduit bending surface.

17. A portable conduit bending frame assembly, comprising:

a support member having a first alignment end, a second alignment end, and a first conduit measuring device that extends an approximate width of the support member, the support member having a flat conduit support surface fixed thereto, and extending substantially perpendicular to a top surface of the support member; the top surface having at least a portion of a first attachment strip located thereon;

a shoe having a first alignment surface extending substantially perpendicular to a second alignment surface, an arcuate conduit bending surface extending between the first and second alignment surfaces; the conduit bending surface facing the conduit support surface, and the shoe being removably attachable to the top surface such that its first alignment surface can be aligned parallel with either alignment end of the support member;

a schedule spacer positionable on the conduit support surface; and a heating device arranged proximate the conduit support surface for heating a conduit prior to bending the conduit at least partially about the conduit bending surface.

18. The portable conduit bending frame assembly of claim 17 further comprising a plurality of interchangeable schedule spacers being interchangeably positionable on the conduit support surface.

* * * * *